United States Patent [19]

Matthias

[11] 4,290,704

[45] Sep. 22, 1981

[54] FLEXIBLE RIBBON GUIDE MEANS

[75] Inventor: Dan W. Matthias, Downingtown, Pa.

[73] Assignee: Exxon Research & Engineering Co., Florham Park, N.J.

[21] Appl. No.: 92,690

[22] Filed: Nov. 9, 1979

[51] Int. Cl.[3] ..... B41J 31/12; B41J 35/04

[52] U.S. Cl. ..... 400/248; 400/208; 226/196

[58] Field of Search ..... 226/196–199; 400/248, 208

[56] References Cited

U.S. PATENT DOCUMENTS

| | | | |
|---|---|---|---|
| 1,935,999 | 11/1933 | Tessky | 226/198 |
| 2,694,130 | 11/1954 | Howard | 226/196 |
| 2,890,619 | 6/1959 | Waller | 226/196 |
| 3,421,675 | 1/1969 | Brown et al. | 226/196 |
| 3,746,234 | 7/1973 | Mischo et al. | 226/196 |
| 3,850,358 | 11/1974 | Nettles | 226/196 |
| 4,047,607 | 9/1977 | Willcox | 400/248 |
| 4,047,608 | 9/1977 | Willcox | 400/248 |

FOREIGN PATENT DOCUMENTS

| | | | |
|---|---|---|---|
| 1046074 | 12/1958 | Fed. Rep. of Germany | 400/248 |
| 2019648 | 11/1971 | Fed. Rep. of Germany | 400/248 |
| 180721 | 9/1962 | Sweden | 400/248 |
| 488569 | 5/1970 | Switzerland | 400/248 |

*Primary Examiner*—William Pieprz

*Attorney, Agent, or Firm*—Norman L. Norris

[57] ABSTRACT

An improved flexible leader for web transport is disclosed which features ribbon enclosing tabs bent up from a flat sheet so as to prevent reverse bending of the leader thus preventing contact of a delicate side of said ribbon with the leader or the remainder of the ribbon supply structure.

10 Claims, 11 Drawing Figures

FLEXIBLE RIBBON GUIDE MEANS

FIELD OF THE INVENTION

The present invention relates generally to the field of providing flexible guide means for guiding a thin ribbon or web from a storage location to a point of use. More specifically, the invention relates to flexible leader means for guiding typing ribbon from a ribbon cartridge which is stationary with respect to a printing machine to a print point which moves with respect to said cartridge, thus necessitating that the leader be flexible.

BACKGROUND OF THE INVENTION

With the advent of computer-controlled printing machines, including word processors and electronic typewriters, the limiting factor on the speed of such machines has shifted from the human operator to mechanical operations performed by the machine itself. Therefore, it has been a goal of the typewriter industry to develop faster and faster printers. Naturally, in order that a printer may print faster and faster, all moving parts must be made of light weight so as to minimize the inertia which must be overcome by motive power means in order that the machine may print.

One expedient which has been commonly adopted in order to lessen the inertia of moving parts is to move the printer mechanism, which may include a hammer and a plurality of character elements, or a rotating ball print element, with respect to the print medium or paper and the platen on which it is supported rather than move the platen with respect to the print element, since, in general, the printer may be made lighter than the platen assembly. To further lighten the inertia of this printer assembly, it has been found desirable to carry the bulk of the inked printing ribbon in a cartridge mounted on the frame of the printing machine and only carry a small portion of it along with the printer. This broad concept is shown in copending applications Ser. Nos. 833,270, filed Sept. 14, 1977, and 833,257, also filed Sept. 14, 1977 as well as U.S. Pat. Nos. 4,047,607 and 4,047,608 to Willcox. The relative motion of the print location with respect to the ribbon supply cartridge necessitates that the leader means conveying the ribbon from the cartridge to the print point and back must be flexible. Such a flexible leader means is the subject of copending application Ser. No. 061,880, filed July 30, 1979. A second version of such a flexible leader is a very important aspect of the present invention as well.

Clearly such a leader, to be successful, must satisfy certain design criteria. It must be sufficiently flexible that it can be flexed back and forth throughout the whole travel of the print location thousands of times without failure. Desirably, it is simply made of inexpensive materials and requires minimal assembly skill or time. It must be so designed as to not permit the delicate inked side of certain typing ribbons (perhaps most notably the so-called single-strike-type) from touching any part of the leader or of the remainder of the ribbon assembly so as to preserve the integrity of its surface.

OBJECTS OF THE INVENTION

It is therefore an object of the invention to provide an improved flexible leader means.

It is a further object of the invention to provide such a leader means which is designed so as to prevent the inked side of a ribbon from touching any part of the leader or ribbon supply mechanism.

It is a further object of the invention to provide a leader which may be manufactured efficiently and inexpensively.

It is a further object of the invention to provide a leader for other types of webs, tapes or ribbons.

Still a further object of the invention is to provide a method whereby such a leader may be made.

Finally, it is an object of the invention to provide an improved ribbon cartridge assembly.

SUMMARY OF THE INVENTION

The above objects of the invention and needs of the art are satisfied by the present invention which comprises a leader having ribbon enclosing means formed by bending alternate tabs up over a central spine to an angle such that said tabs overlap. In this way, bending of the leader is prohibited in one direction and is permitted in the other. The leader may desirably be formed out of plastics materials such as "Lexan" polycarborate and may be so formed as to be a snap together assembly with the remainder of the ribbon locating means.

BRIEF DESCRIPTION OF THE DRAWING

The invention will be better understood if reference is made to the accompanying drawing in which.

Figure 8A:
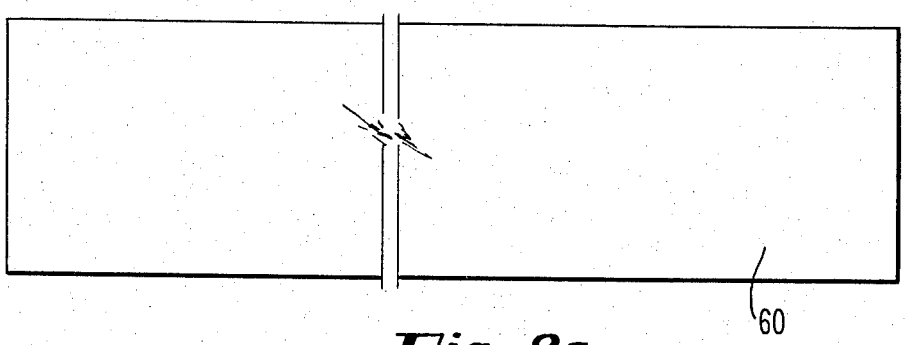
Figure 8B:
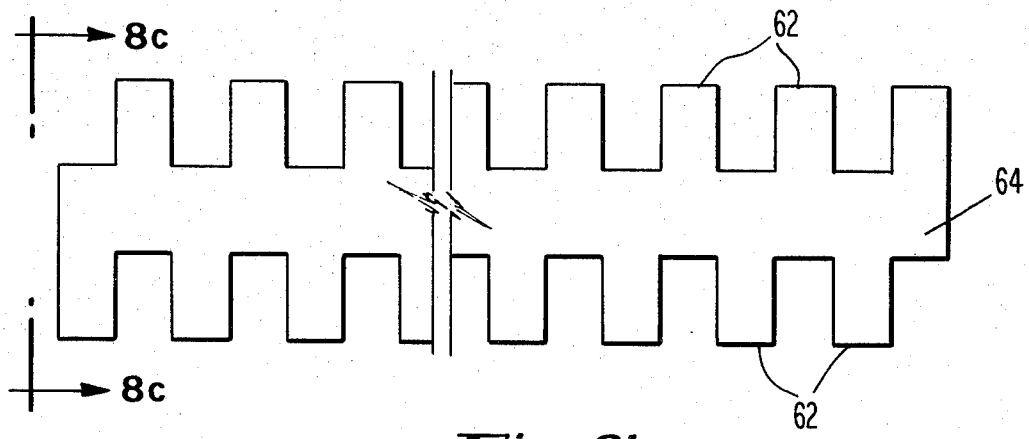

FIG. **8*a*** is a sheet of plastic preparatory to a first step in the method of manufacture of the leader;

FIG. **8*b* is the sheet of FIG. 8*a*** after the said first step has been performed;

FIG. **8*c* is a cross section along the line 8*c*—8*c* of FIG. 8*b*;**

FIG. **8*d*** shows an end view of the final leader after having been formed.

DESCRIPTION OF THE PREFERRED EMBODIMENTS

Figure 1:
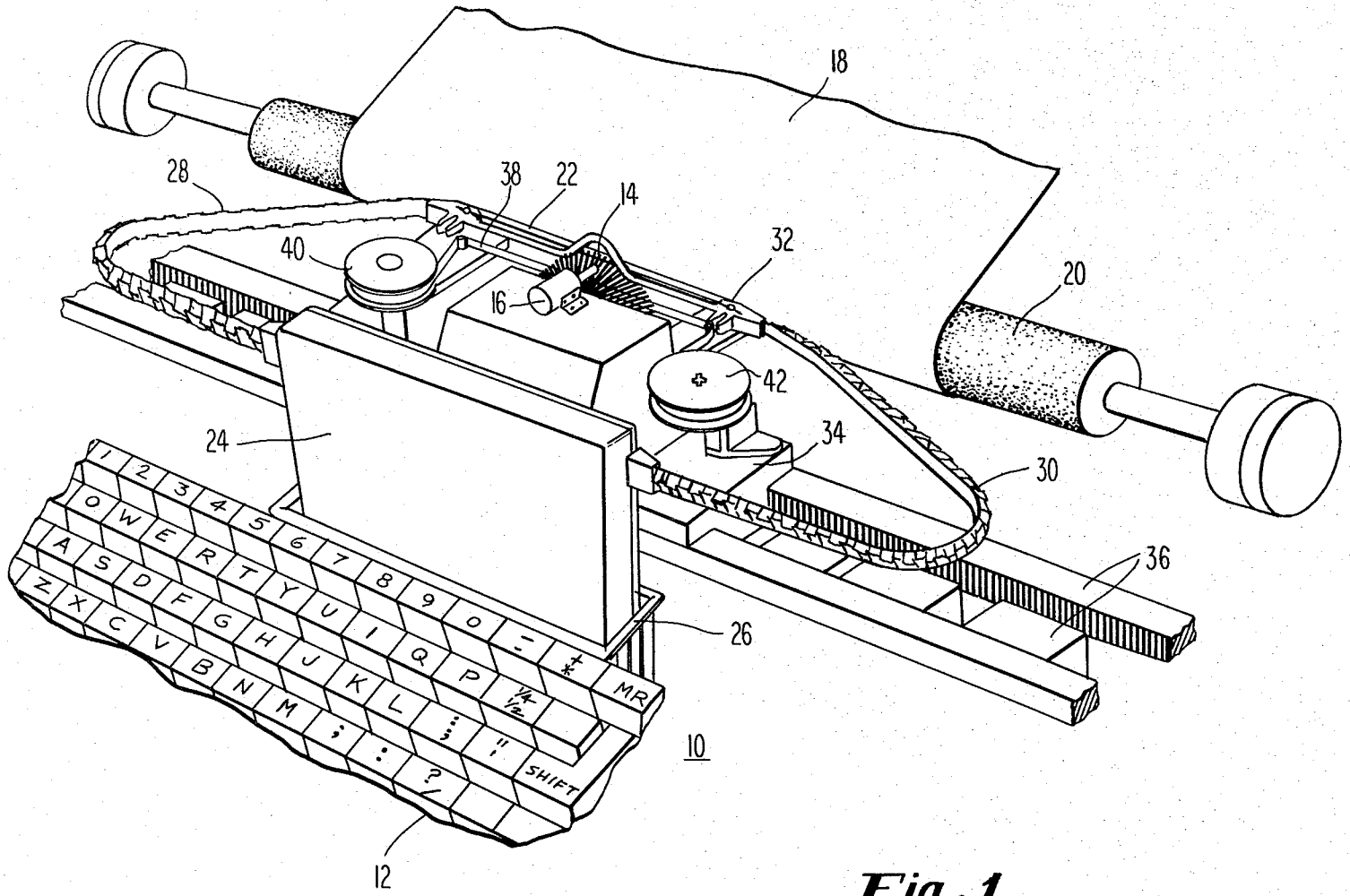
FIG. 1 represents an overall view of the leader of the invention in a typewriter.

Referring now to FIG. 1, an overall view of a typewriter 10 is shown. The typewriter 10 comprises a keyboard 12 which controls, inter alia, the motion of a print wheel 14 comprising a number of spokes having character elements formed on the ends thereof and adapted to be impacted by a hammer 16 driving the character elements into a paper 18 supported by a platen 20. A ribbon 22 produces a mark on paper 18 when a character element is impacted thereinto. The ribbon 22 is supplied from a ribbon cartridge 24 which is detachably mounted in a recessed receiver 26 and the ribbon 22 is carried back and forth from the cartridge 24 to the print point defined by the hammer 16 by leaders 28 and 30. The ribbon 22 is exposed in the vicinity of the character elements by means of a ribbon locator 32 which together with the hammer 16 and print wheel 14 is carried on a carriage 34, desirably driven back and forth with respect to the platen 20 by a linear stepper motor 36.

An erase ribbon 38 may also be carried on the carriage 34 and be supplied from a first reel 40 and be taken up by a second reel 42. As shown, both erase and print ribbons 38 and 22 are disposed somewhat below the print point. They are lifted by lifter means (not shown) when it is desired to print or erase a character so that the typist may see what he or she has typed. This necessitates that the leaders 28 and 30 be flexible in the vertical as well as in the horizontal dimension.

Figure 2:
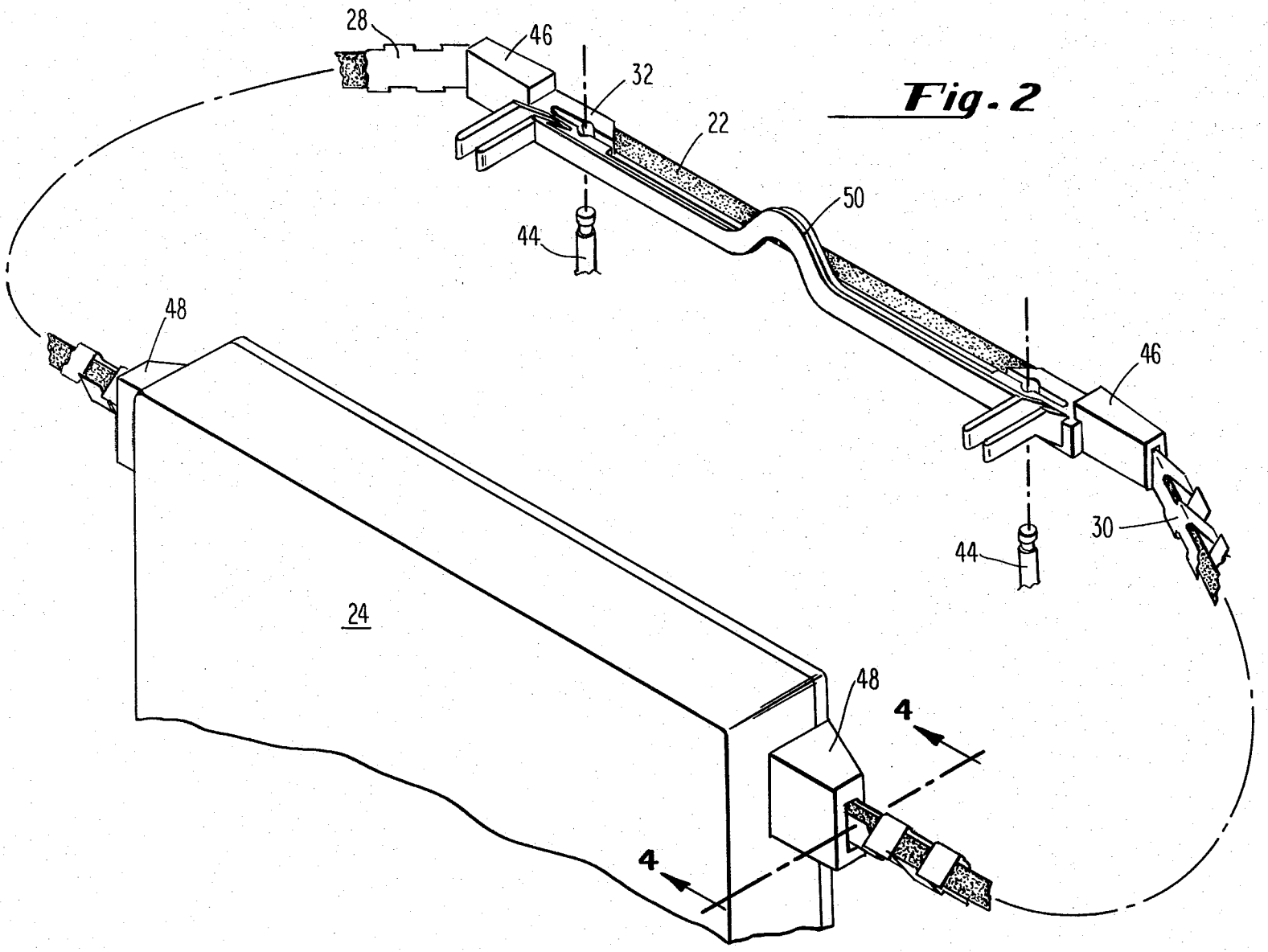
FIG. 2 represents an enlarged view of the cartridge assembly of the invention together with leader means and ribbon locating means.

Referring now to FIG. 2, an overall view of the ribbon cartridge system of the invention is shown. It comprises a cartridge 24, leaders 28 and 30 and ribbon locator 32. Ribbon locator 32 may desirably be of the form disclosed in copending application Ser. No. 061,454, filed July 27, 1979. It may comprise a relatively rigid plastic material of fixed length adapted to mate releasably with pins 44 and may be provided with end means 46, discussed in further detail below, for attachment to the leaders 28 and 30. The cartridge 24 may likewise be provided with attachment means 48 for connection with said leader. When it is desired to print a character, the pins 44 lift up the ribbon locating means 32, thus positioning the ribbon 22 in juxtaposition to a print receiving medium or paper 18, whereby the characters may be impacted by the hammer 16 causing the corresponding mark to be printed on the paper 18 by the ink of the ribbon 22. The ribbon locator 32 may be provided with an uplifted central section 50 through which the hammer 16 and character element may pass on their way to the ribbon.

Figure 3:
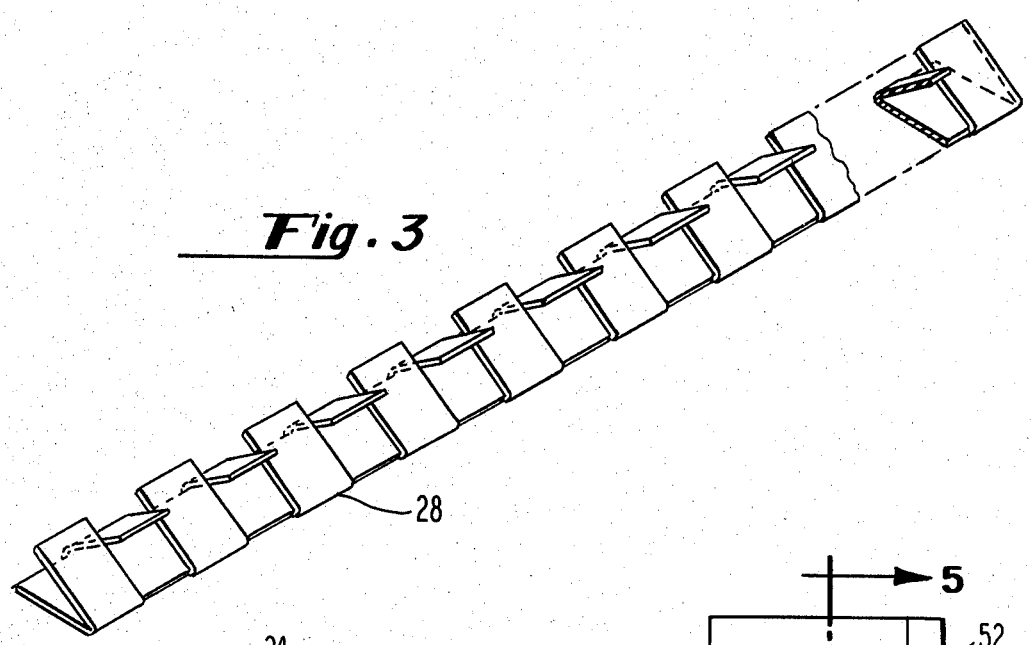
FIG. 3 represents a perspective view of the leader.

Referring now to FIG. 3, the general configuration of the leader 28 may be observed. Leader 30 is substantially identical. In either case, the leader 28 desirably comprises a unitary piece of plastic having alternating tabs formed on either side of a central spine thereof and folded toward one another to an angle such that when the leader is in a straight position (as shown in FIG. 3) the edges of the tabs abut, thus preventing any further bending of the leader 28 in the direction of bending of said tabs. Bending of the web in the other direction of course is permitted. In this way, reverse bending (i.e., bending past the straight in one direction) is prohibited, and the ribbon need only touch the leader on one side. Desirably, therefore, the plastic material chosen to form the leader 28 is of a material which will permit the bending of said tabs in a manner such that they will stay bent whereas bending of the web along the path of the ribbon 22 is permitted flexibly; that is, the memory characteristic of the plastic is such that the sharp bend made by the tab tends to be permanent, while the bend of the leader between the cartridge and print point is not. Desirably, there are no discontinuities of bending formed at the locations of the tabs but rather the leader bends continuously therealong, such that the spine flexes substantially uniformly. It presently appears that a suitable material is "Lexan" polycarbonate; however, other materials may in time appear to be useful as well.

Figure 5:
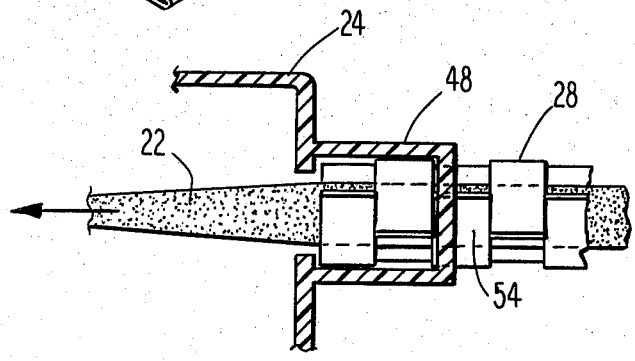
FIG. 5 represents a cross-sectional view taken along line 5—5 of FIG. 4.
Figure 4:
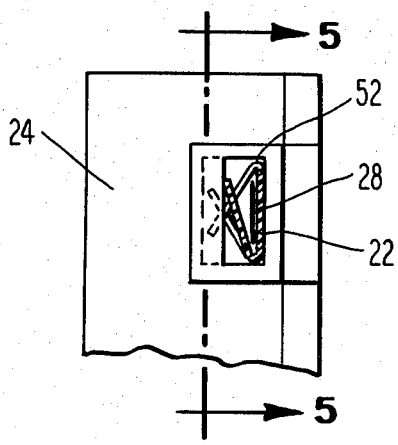
FIG. 4 represents a view of the attaching means used to secure the leader to the cartridge, and is a cross-sectional view taken along line 4—4 of FIG. 2.

Referring now to FIG. 4, which shows a cross-sectional view taken along the line 4—4 of FIG. 2, it is seen how the leader of the invention 28 may be operably connected to a cartridge 24. In the embodiment shown in FIG. 4, the leader 28 may be inserted into an aperture 52 sized so that the tabs or legs of the leader 28 must be somewhat compressed to permit the leader to go in and are then permitted to expand into a larger opening behind the aperture 52, as shown in phantom. The relative position of ribbon 22 is shown for clarity. FIG. 5 is a cross-sectional view taken along line 5—5 of FIG. 4 and shows how this might be accomplished. It will be observed that the leg 54 which is at the level of the aperture 52 is compressed with respect to the other legs of the leader 28. It will be appreciated that the attaching means 48 on the other side of the cartridge may be substantially identical and that the leader 30 may fit therein in substantially the same manner.

Figure 7:
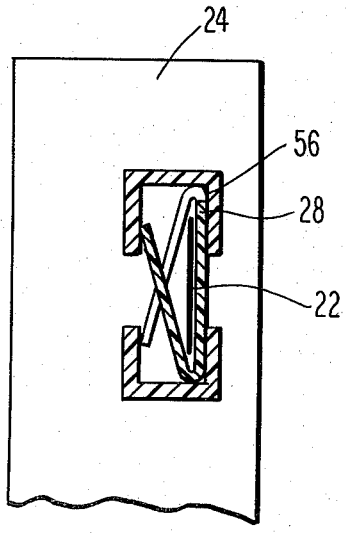
FIG. 7 is a cross-sectional view taken along lines 7—7 of FIG. 6.
Figure 6:
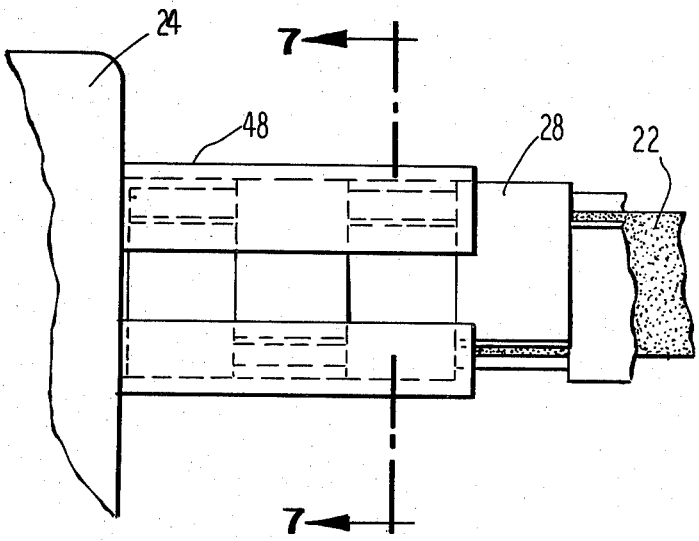
FIG. 6 represents a second method of attaching a leader according to the invention to a ribbon cartridge.

A second scheme of attaching the leader to the cartridge is shown in FIGS. 6 and 7. There an aperture 56 is provided, so sized that the folded edges of the leader fits snugly therewithin. In such a case, the leader would simply be pressed into the attaching means 48 of the cartridge 24. Examination of FIGS. 4 and 7 also shows the desirable relative size of the ribbon 22 with respect to the leader 28. That is, there is sufficient room provided within the folded over portions or legs of the leader 28 that the ribbon 22 may move freely therewithin. This is also of significance when considering the angle through which the tabs of the leader are folded; clearly, if this angle is too acute, the tabs would tend to cramp the motion of the ribbon 22 therewithin.

Figure 8C:
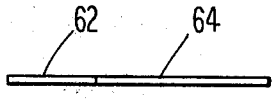
Figure 8D:
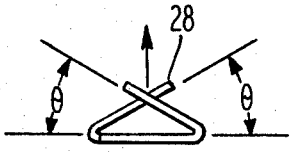

FIGS. 8*a* through 8*d* refer to various steps in the method of manufacture of the leader according to the invention. FIG. 8*a* shows a sheet of plastic which as discussed above may be desirably formed of polycarbonate. FIG. 8*b* shows the leader precursor, comprising a spine 64 and tabs 62 having been cut from the sheet of plastic of FIG. 8*a*, which operation may be performed on a roller die, punch press, or similar well known prior art expedients. The width of the tabs is shown as equal to the spacing therebetween, so that the leader cannot flex, in one direction, past the straight. It will be realized that by making the tabs slightly wider than the spaces, a maximum radius of bending will be defined. FIG. 8*c* shows a cross-section along the line 8*c*—8*c* of FIG. 8*b*, and indicates the relative spacing of the two sides of the tabs. Finally, FIG. 8*d* shows the tabs 62 having been folded over in the direction of the arrow, in which direction the leader cannot be flexed past a substantially straight position; the bending operation could be done simply on a rolling machine of well known type. Preferably the angles $\theta$ formed by the tabs with respect to the spine of the leader are equal, but this is not in itself crucial as long, as discussed above, they are bent through a sufficient angle as to overlap so as to abut one another, thus preventing back bending of the leader and contact of the inked side of the ribbon with the leader, but not being so far bent that they cramp the motion of the ribbon 22 within the leader 28. Desirably, the angle of bending (that is, 180° minus $\theta$) is between 100° and 160°.

It will be appreciated that there are numerous modifications and improvements which can be made to the flexible leader of the invention in order to further perfect its function. In particular, the cross-sectional shape of the formed leader need not be triangular, as it has been shown, but could be any regular polygonal shape particularly rectangular, which would be adequate to fulfill the objects of the invention and which would be relatively simple to perform. Further improvements can be made in the selection of materials for the leader of the invention. Another possibility is that the sheet of plastic from which the leader is formed need not be flat, and might have other shapes molded or otherwise formed into it; an example would be longitudinally extending ridges along the central web or spine of the leader which would prevent planar contact between the ribbon and the leader, which might in some circumstances be useful in preventing friction therebetween. Another possibility relates to forming attaching means at the ends of the leader which might simplify the design of the attachment of the leader to the ribbon locating means and to the cartridge housing.

Finally, it should be appreciated that the leader of the invention has applicability beyond the typewriter or printing machine art. In particular, wherever a thin web having a delicate surface thereon, such as for example a magnetic tape, needs to be transported, the flexible leader of the invention may find utility in the systems concerned therewith.

Therefore, the above description of the invention should be considered as exemplary only and not as a limitation on its scope, which is more properly defined by the following claims.

What is claimed is:

1. An improved leader means for use in a printing machine of the type utilizing a stationary ribbon supply means and flexible leader means for guiding ribbon to the print location of said machine, said print location being relatively moveable with respect to said supply means comprising:

a central web formed from a flexible material having tabs projecting in alternate fashion from said central web and being bent through an angle with respect to said web such that the distal ends of said tabs overlap with one another thereby forming a channel within which said ribbon may be guided, said leader being bendable in a first direction but not bendable past the flat in an opposite direction.

2. The machine according to claim 1 wherein said leader is formed of polycarbonate plastic.

3. The machine according to claim 1 wherein said angle is between 100° and 160°.

4. A cartridge assembly for supplying ribbon to a point of use, comprising:

a cartridge having a supply of ribbon therein; and flexible leader means for interconnecting said cartridge and said point of use and for conveying ribbon therebetween, wherein said leader is a single piece of flexible plastic having a continuous spine and ribbon-enclosing projections alternating with one another from opposing sides of said spine over said spine, the length of said projections and the angle of such projection with respect to said spine being such that substantial bending of said spine in one direction is precluded.

5. The assembly of claim 4 wherein said projections confine said ribbon in substantially parallel relationship with said spine.

6. The assembly of claim 4 wherein said ribbon is an inked typing ribbon, and said point of use is a print location in a printing machine.

7. A flexible leader comprising a means for enclosing a web and a spine for supporting said web, said leader being formed integrally from a single strip of flexible material with alternating discontinuities in the opposing edges thereof, said enclosing means being integrally formed of said opposing edges of said strip, said discontinuities being arranged so as to abut one another when said leader is substantially straight whereby said leader is constrained to flex in only one direction.

8. For use in an apparatus for feeding a web, a means for defining a web path comprising flexible means for enclosing said web, said means having tabs formed from alternating protrusions from a central spine, said tabs being arranged so as to abut one another when said path defining means is substantially straight such that said path is permitted to curve along a substantially uniform radius and is constrained to flex in only one direction.

9. Means according to claim 8 wherein said tabs are said enclosing means.

10. Means according to claim 8 wherein said tabs abut one another when said spine is in a substantially straight configuration.

* * * * *